United States Patent [19]

Love et al.

[11] Patent Number: 4,996,066

[45] Date of Patent: Feb. 26, 1991

[54] BEVERAGE FLAVORING CASSETTE

[75] Inventors: Graham Love; Karl Schellhaass; Bärbel Rathjen, all of Bremen; Jürgen Schwarz, Bremerhaven, all of Fed. Rep. of Germany

[73] Assignee: Hag GF Aktiengesellschaft, Bremen, Fed. Rep. of Germany

[21] Appl. No.: 351,736

[22] Filed: May 15, 1989

[51] Int. Cl.[5] ..... B65D 85/00; B65B 29/02; A47J 31/00

[52] U.S. Cl. ..... 426/77; 426/79; 426/433; 99/295; 99/304; 99/306

[58] Field of Search ..... 426/77, 112, 115, 433, 426/78, 79; 210/474, 482, 475; 99/295, 304, 306, 302 R, 317, 323; 220/67

[56] References Cited

U.S. PATENT DOCUMENTS

| | | | |
|---|---|---|---|
| 846,261 | 3/1907 | Thomas | 210/474 |
| 1,377,316 | 5/1921 | Clermont | 99/295 |
| 1,412,388 | 4/1922 | Clermont | 426/77 |
| 1,628,394 | 5/1927 | Montmorency | 210/474 |
| 2,539,771 | 1/1951 | Chambers | 99/295 |
| 2,715,868 | 8/1955 | Brown | 99/302 R |
| 2,822,273 | 2/1958 | Anderson | 99/295 |
| 3,083,101 | 3/1963 | Noury | 426/77 |
| 3,411,431 | 11/1968 | Moerlini et al. | 99/304 |
| 3,445,237 | 5/1969 | Gidge | 426/77 |
| 3,607,299 | 9/1971 | Bolt | 426/77 |
| 3,640,727 | 2/1972 | Heusinkveld | 426/77 |
| 3,811,373 | 5/1974 | Telco | 426/77 |
| 3,823,656 | 7/1974 | Vanderveken | 99/295 |
| 3,889,000 | 6/1975 | Cante | 426/77 |
| 3,937,134 | 2/1976 | Molenaar et al. | 426/77 |
| 3,985,069 | 10/1976 | Cavallurri | 426/77 |
| 4,027,582 | 6/1977 | O'Connell | 99/306 |
| 4,054,205 | 10/1977 | Blow et al. | 206/217 |
| 4,119,019 | 10/1978 | Reid | 99/306 |
| 4,136,202 | 1/1979 | Favre | 426/77 |
| 4,158,329 | 6/1979 | McKnight | 99/295 |
| 4,167,899 | 9/1979 | McCormick | 426/77 |
| 4,255,265 | 3/1981 | Grevtert | 210/474 |
| 4,446,158 | 5/1984 | English et al. | 426/77 |
| 4,465,697 | 8/1984 | Brice et al. | 426/77 |
| 4,550,024 | 10/1985 | Le Granse | 426/77 |
| 4,853,234 | 8/1989 | Bentley et al. | 426/77 |
| 4,867,993 | 9/1989 | Nordskog | 426/77 |

FOREIGN PATENT DOCUMENTS

| | | | |
|---|---|---|---|
| 1429932 | 3/1969 | Fed. Rep. of Germany | 210/482 |
| 3432339 | 3/1986 | Fed. Rep. of Germany | 210/474 |
| 1347892 | 11/1962 | France | 99/306 |
| 8302168 | 1/1985 | Netherlands | 99/295 |

*Primary Examiner*—Steven Weinstein
*Attorney, Agent, or Firm*—Linn I. Grim

[57] ABSTRACT

A cassette for flavoring a liquid and for use with a liquid receptacle having an internal locking flange. The cassette comprises a ring defining an interior and forming a bottom annular groove to receive the locking flange of the liquid receptacle and thereby to hold the cassette in place therein. The cassette further includes a plurality of ribs connected to and extending across the ring and separating the interior thereof into a multitude of sections, and particles disposed in said sections for flavoring a liquid. A bottom filter and a top filter are secured to the ring and extend across the bottom and top, respectively, of the interior of the ring to hold the flavoring particles therein. Preferably, the cassette is packaged in a sealed vacuum pack; and as it is so packaged, the mass of particles in each section of the cassette is reshaped slightly and formed into a firm conglomerate, which facilitates the subsequent flow of a liquid through the cassette.

9 Claims, 2 Drawing Sheets

BEVERAGE FLAVORING CASSETTE

BACKGROUND OF THE INVENTION

This invention generally relates to apparatus for flavoring liquids; and more specifically, to a prepackaged, single use cassette holding a quantity of particles for flavoring a liquid passed through the cassette.

Prepackaged, single use cassettes of the above-described general type are known in the art, and for example, such a cassette is disclosed in U.S. Pat. No. 4,446,158. This reference discloses a coffee brewing receptacle having an opening in the bottom thereof, and a disposable, single use coffee container and filter unit that is designed to be held in the bottom opening of that coffee brewing receptacle. This coffee unit, in turn, comprises a frame, top and bottom filters secured to and covering the top and the bottom, respectively, of the frame, and individual quantities of coffee held in compartments formed inside the frame.

In use, the coffee container and filter unit is tightly secured against a lower flange of the coffee brewing receptacle, with the coffee unit extending across the bottom opening of that receptacle. This receptacle is then placed on top of a cup, and hot water is poured through the coffee brewing receptacle and the coffee unit secured across its bottom opening. The hot water is flavored as it flows through the coffee unit, producing coffee, which passes into the cup below the coffee unit. With the above described apparatus, it is sometimes difficult to secure the coffee container and filter unit in, and subsequently to remove that unit from, the brewing receptacle.

U.S. Pat. No. 3,937,134 discloses an apparatus for making coffee by percolation of preheated water. This apparatus comprises a reservoir adapted to receive water, and an extraction chamber adapted to receive a ground coffee tablet, which will expand or swell when percolated. A perforated wall separates the reservoir from the extraction chamber; and, in use, water flows or trickles from the reservois, through the perforated wall and into the extraction chamber through gravity.

U.S. Pat. 3,823,656 discloses a single-use, throw-away coffee brewing apparatus, including a filtering body adapted to receive a liquid and a coffee containing cartridge or capsule secured to the bottom of that body, A special locking design is used to hold the coffee cartridge to the filtering body to prevent relative movement therebetween and to form a seal between the coffee cartridge and the filtering body.

A number of difficulties have arisen in using prior art devices employing single-use, prepackaged coffee cassettes or cartridges to brew small quantities of coffee. For instance, often these devices do not consistently produce coffee with the same strength, the devices may take an undesirable length of time to make coffee, or the devices may be costly to make or use.

SUMMARY OF THE INVENTION

This invention provides an improved pre-packaged single use cassettes for flavoring liquids.

Another aspect of the present invention is to mount a cassette, which contains liquid flavoring particles, on an internal flange on the bottom of a liquid receptacle to hold the cassette in place therein while liquid is passed through the cassette.

A further aspect of this invention is to place liquid flavoring particles in individual compartments of a cassette, to place the cassette inside a packet, and then to withdraw air from the packet to form a vacuum therein in a manner that forms the flavoring particles in each compartment into a firm conglomerate to facilitate subsequently passing a liquid through the cassette.

By this invention there is described a cassette for flavoring a liquid and for use with liquid receptacle having an internal locking flange. The cassette comprises a ring forming a bottom annular groove to receive the locking flange of the liquid receptacle and thereby to hold the cassette in place therein. The cassette further includes a plurality of ribs connected to and extending across the ring and separating the interior thereof into a multitude of sections, and flavoring particles are disposed in these sections to flavor a liquid. A bottom filter and a top filter are secured to the ring and extend across the bottom and the top, respectively, of the ring to hold the flavoring particles in the sections thereof.

Preferably, the ring of the cassette includes an inside annular leg, an outside annular leg radially spaced from and concentric with the inside annular leg, and a shoulder portion connected to and extending between the annular legs, and the inside and outside annular legs and the shoulder portion form the above-mentioned annular groove of the ring. In addition, preferably the cassette is packaged in a vacuum sealed packet; and as it is so packaged, the mass of particles in each section of the ring is reshaped slightly and formed into a firm conglomerate to facilitate subsequently passing a liquid through the cassette.

Further benefits and advantages of the invention will become apparent from a consideration of the following detailed description given with reference to the accompanying drawings, which specify and show preferred embodiments of the invention.

DETAILED DESCRIPTION OF THE PREFERRED EMBODIMENTS

Figure 1:
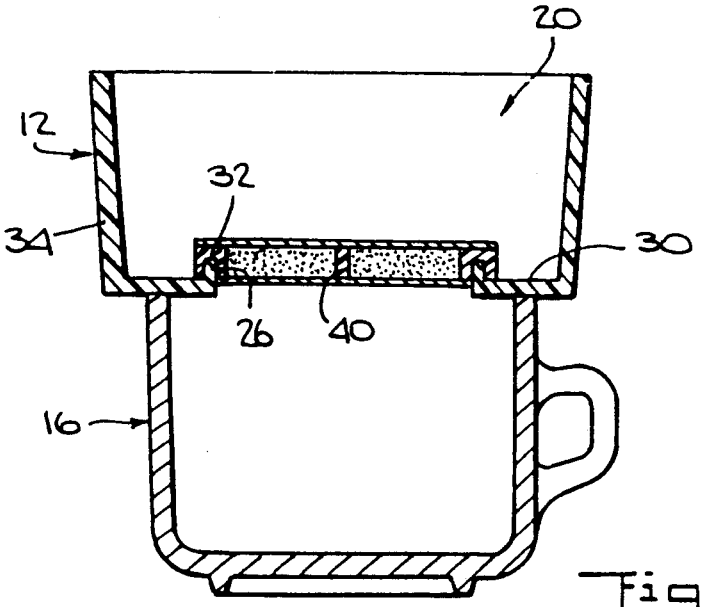
FIG. 1 is a vertical cross-sectional view through a liquid receptacle, a cassette held in the receptacle for flavoring a liquid, and a cup beneath that receptacle.

FIG. 1 illustrates liquid receptacle 12, flavoring cassette 14, and cup 16. Generally, receptacle 12 defines an interior 20 to receive a liquid and a bottom opening 22 to allow the liquid to Pass through the receptacle; and, in use, cassette 14 is held in receptacle 12, extending over and across bottom opening 22. Cassette 14, in turn, holds a supply of flavoring particles 24 (shown in FIGS. 2 and 3), and the receptacle and cassette are mounted on cup 16 so that liquid passes through the receptacle and the flavoring cassette and collects in the cup. To hold cassette 14 in place inside receptacle 12, the receptacle includes a bottom flange 26 extending upward from bottom portion 30 thereof and around opening 22, the cassette forms an annular channel 32 having a shape complementing the shape of flange 26, and the cassette is placed in the receptacle with flange 26 in groove 32. This arrangement holds the cassette securely in place while liquid flows through it, and also forms an effective liquid seal between the cassette and the bottom of the receptacle, extending around opening 22, to prevent liquids from leaking out from the receptacle through the interface between the cassette and the liquid receptacle.

Any suitable liquid receptacle 12 may be used to hold cassette 14, As shown in FIG. 1, the receptacle has a generally flat bottom portion 30 and a generally cylindrically shaped side wall portion. Bottom portion 30 forms through opening 22, which preferably has a circular shape and is centered in the bottom portion. In addition, preferably flange 26 extends upward from bottom portion 30, immediately outside of and continuously completely around opening 22. A plurality of tabs, lugs or brackets (not shown) may be connected to bottom portion 30, for instance as disclosed in U.S. Pat. No. 4,446,158, so that receptacle 12 can be adapted to seat on any of a variety of sizes or diameters of cups or other containers and to facilitate positioning and holding the receptacle on the cup. Liquid receptacle 12 may be made in any suitable manner and from any suitable material, and preferably the bottom portion 30, side portion 34 and locking flange 26 are integrally formed together from a plastic material.

Figure 2:
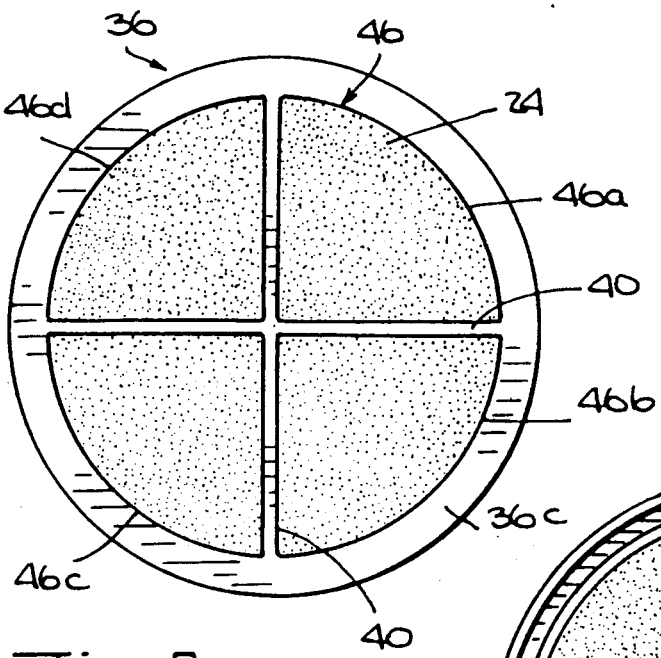
FIG. 2 is a top view of the cassette of FIG. 1, with portions removed.
Figure 3:
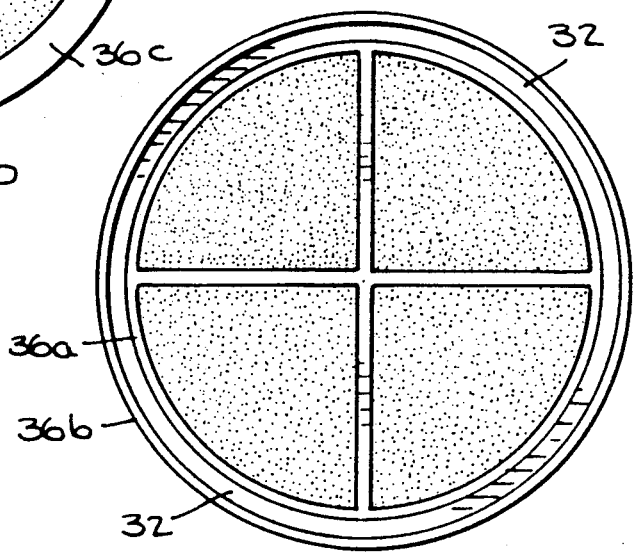
FIG. 3 is a bottom view of the cassette, also with portions removed.
Figure 4:
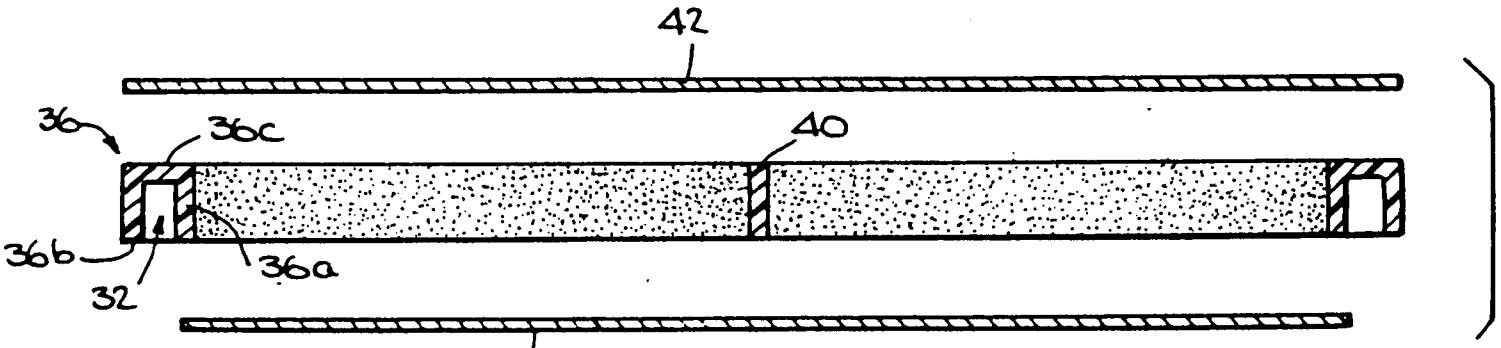
FIG. 4 is an enlarged, exploded side view of the cassette.

FIGS. 2–4 illustrate cassette 14 in greater detail; and generally, the cassette includes ring member 36, ribs 40, top filter 42 and bottom filter 44 and flavoring particles 24; and the ring member 36, in turn, includes inside leg 36*a*, outside leg 36*b* and shoulder 36*c*. Both inside and outside legs 36*a* and *b* have annular or circular shapes, and the outside leg is radially spaced from and is concentric with the inside leg. Annular shoulder 36*c* is connected to and radially extends between top portions of legs 36*a* and *b;* and, in this way, shoulder 36*c* and legs 36*a* and *b* form the annular channel 32. Preferably, the height of legs 36*a* and *b* is substantially equal to the height of locking flange 26 of receptacle 12, and these legs are spaced apart a distance substantially equal to the width of that flange. As a result, cassette 14 can be mounted on flange 36 in a secure pressure fit thereagainst.

Ring member 36 defines an interior space 46, and ribs 40 are connected to the ring member and extend across that interior space to separate that space into a multitude of sections or compartments 46*a–d*. The embodiment of cassette 14 shown in the drawings includes two ribs 40, each of which extends diametrically across ring member 36, so that his interior space 46 is separated into four equal quadrants. Other arrangements are possible, however. For instance, cassette 14 may be provided with three radial ribs that are connected together to form a Y extending across space 46 and separating that space into three compartments. It has been found that a cassette with only two compartments is not considered satisfactory. As still another example, cassette 14 may be provided with three diametrical ribs, each of which extends across a respective one diameter of ring 36, and that, taken together, separate the interior of the ring into six equal compartments. Regardless of the specific number of ribs that cassette 14 is provided with, preferably each of these ribs has the same height as ring member 36.

Filters 42 and 44 are suitably secured to top and bottom surfaces of ring member 36 and extend across space 46 to hold flavoring particles 24 therein while allowing liquids to pass through cassette 14 and through those particles. These filters may comPrise any suitable filter paper, and they may be heat sealed, for example, to ring 36 or be otherwise secured thereto. Preferably, bottom filter 44 is secured to bottom surfaces of inner leg 36*a*, and this filter terminates radially inwardly of channel 32 to avoid interfering with placing or mounting cassette 14 on flange 26.

Liquid flavoring particles 24 are held in the compartments 46*a–d* of cassette 14; and preferably an equal amount of particles is held in each of the compartments, and each compartment is substantially filled with those flavoring particles. As will be understood by those of ordinary skill in the art, in order to make cassette 14, a first of the filters 42, 44 is secured to ring 36; the compartments 46*a–d* are filled with the desired amounts of particles 24; and after this, the other filter 42, 44 is secured to the remaining open end of ring 36.

As also will be appreciated, any suitable cup 16 may be used with receptacle 12 and cassette 14. Many such cups are very well known, and it is unnecessary to describe cup 16 further herein.

The present invention is particularly well suited for making coffee; and in such a case, particles 24 are roast and ground coffee beans wherein the coffee is extracted with hot water. For example, when used to make coffee, it is believed that excellent results can be achieved if all of the particles 24 are sized predominately between about 200 and about 500 microns. This means that at least 75% and preferably at least 95% of the particle sizes fall within the 200 to 500 micron size. The particle sizes of the coffee (which are roast and ground type) can include particles above or below the ranges of 200 to 500 microns and still provide outstanding results. The average median particle size preferred is between 350 to 450 microns. It is believed that such particles will not swell significantly as the coffee is made but will leave interspaces, and that hot water will pass through the particles relatively rapidly. Further, it is believed that by using ultra-fine ground coffee particles, a beverage of a given strength can be made using less total coffee that if the ground coffee particles are larger.

Of course, the present invention can be used with widely varying particle sizes, and with many other types of particles such as tea components.

In use, with reference again to FIG. 1, cassette 14 is mounted on locking flange 26 of receptacle 12, and this receptacle is placed on cup 16, with the flavoring cassette generally centered over the top of the cup: and then, a liquid such as hot water, is poured into receptacle 12. The liquid passes through receptacle 12 and cassette 14 and is flavored by the particles 24 in the cassette, and the beverage produced thereby is collected in cup 16. After the liquid has flowed through cassette 14, the liquid receptacle and the cassette are removed from the cup. The cassette may then be removed from the liquid receptacle and disposed of, and the liquid receptacle can be washed and stored for another use. The cassette 14 is very easy to place in and remove from liquid receptacle 12; and, for example, the cassette can be removed by just inverting the liquid receptacle.

Liquid receptacle 12 and flavoring cassette 14 may be made in various sizes. For instance, as illustrated in FIG. 1, the receptacle and cassette are of a size specifically designed to make one cup of coffee. The receptacle and cassette may be made larger or smaller. Larger cassettes, for instance, may be ideally suited to restaurant use or to use on airplanes, where each cassette may be used to make 10–12 cups of coffee. Although atmospheric brewing of the coffee is satisfactory for making multiple cups of coffee, it is desirable to place these larger quantities of coffee under pressure to decrease brewing time.

Figure 5:
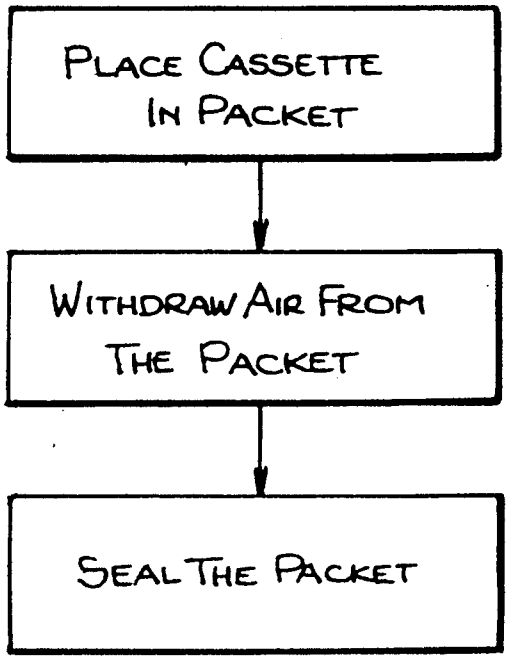
FIG. 5 generally indicates a procedure for packaging the cassette.

It has been found that the rate at which liquid flows through cassette 14 may be dramatically improved as a result of the preferred method used to package the cassette. To elaborate, with reference to FIG. 5, after cassette 14 is made, as described above, preferably the cassette is placed in a small envelope or packet, most or all of the air is withdrawn by vacuum from the packet, and the packet is sealed, producing a package referred to as a sealed vacuum pack. This means that the amount of oxygen removed during the vacuum operation is significantly reduced and desirably to as low as 1% of the total oxygen originally present. The principle reason for packaging the cassette in this way is to maintain the freshness of the flavoring particles 24. It has been found, though, that as air is withdrawn from the packet, the mass of particles in each compartment 46*a–d* of the cassette is re-shaped and formed into a firm conglomerate; and that when the cassette is later removed from the packet and used in the manner outlined above, the liquid that is poured into receptacle 12 flows through the cassette at a rate greater than the rate at which the liquid flows through an otherwise identical cassette that was not similarly vacuum packed.

It is important that the coffee particles in the individual sections of the cassette be distributed in a manner that these sections are not completely filled with particles so that there is room for distribution of the coffee particles to form a conglomerate of particles in each section of the cassette when placed in a small envelope or packet and vacuum is applied to remove the oxygen to form a sealed vacuum pack. If the coffee particles are not distributed when vacuum is applied, the advantages of the vacuum process are not achieved.

The following examples will help to further illustrate the invention.

EXAMPLE 1

Two cassettes as described in FIGS. 2 and 3 of the drawings were each provided with 7.0 grams of finely ground roast and ground coffee beans, consisting of particles predominately between about 200 and 500 microns in size, and a first cassette was then vacuum packed to remove substantially all the air as described above, while the second cassette was not vacuum packed. Under substantially identical conditions, each cassette was placed in a liquid receptacle, over a bottom opening thereof, and substantially the same amount of hot water was poured through each liquid receptacle and the cassette thereon. Substantially all of the water flowed through the first cassette in about thirty six seconds, while about a minute and eight seconds was required for substantially all of the water to flow through the second cassette.

| | Cassette #1 68/70 mm in diameter (vacuum packed) | Cassette #2 68/70 mm in diameter (not vacuum packed) |
|---|---|---|
| Weight of coffee in cassette (grams) | 7.0 | 7.0 |
| Roast and ground coffee particle size | Predominately 200–500 microns | Predominately 200–500 microns |
| Amount of hot water poured through the coffee (ml.) | 141 | 142 |
| Time required for the hot water to flow through the coffee | 36 seconds | 1 minute 8 seconds |

From each of these cassettes, cups of coffee of essentially equivalent strength are obtained even with the time difference.

EXAMPLE 2

Two cassettes as described in FIGS. 2 and 3 of the drawings were each provided with 7.0 grams of finely ground roast and ground coffee beans, consisting of particles less than 630 microns in size with the predominant size being between 200 and 500 microns; and a first cassette was then vacuum packed to remove substantially all of the air as described above, while the second cassette was not vacuum packed. Under substantially identical conditions, each cassette was placed in a liquid receptacle, over a bottom opening thereof, and substantially the same amount of hot water was poured through each liquid receptacle and the cassette therein. Substantially all of the water flowed through the first cassette in about thirty-seven seconds, but about a minute and eleven seconds was needed for the water to flow through the second cassette.

| | Cassette #1 68/70 mm in diameter (vacuum packed) | Cassette #2 68/70 mm in diameter (not vacuum packed) |
|---|---|---|
| Weight of coffee in cassette (grams) | 7.0 | 7.0 |
| Roast and ground coffee particle size | less than 630 m Predominately between 200–500 microns | less than 630 m Predominately between 200–500 microns |
| Amount of hot water poured through the coffee (ml.) | 141 | 142 |
| Time required for the hot water to flow through the coffee | 37 seconds | 1 minute 11 seconds |

From each of these casettes, cups of coffee of essentially equivalent strength are obtained even with the time difference.

EXAMPLE 3

Two cassettes as described in FIGS. 2 and 3 of the drawings were each provided with 7.0 grams of ground roast and ground coffee beans consisting of coffee particles which are not predominantly in the 200 to 500 microns size range and are not prescreened a first cassette was vacuum packed to remove all of the air as described above, while the second cassette was not vacuum packed. Under substantially identical conditions, each cassette was placed in a liquid receptacle, over a bottom opening thereof and substantially the same amount of hot water was poured through each liquid receptacle and the cassette therein with the following results:

| | Cassette #1 68/70 mm in diameter (vacuum packed) | Cassette #2 68/70 mm in diameter (not vacuum packed) |
|---|---|---|
| Weight of coffee in cassette (grams) | 7.0 | 7.0 |
| Roast and ground coffee particle size | as ground and not screened (not predominately 200–500 microns) | as ground and not screened (not predominately 200–500 microns) |
| Amount of hot water poured through the coffee (ml.) | 141 | 142 |
| Time required for the hot water to flow through the coffee | 1 minute 46 seconds | 2 minutes 22 seconds |

From each of these cassettes, cups of coffee of essentially equivalent strength are obtained even with the time difference.

EXAMPLE 4

Using an identical cassette (63–65mm in diameter as described in U.S. Pat. No. 4,446,158, English, et. al.) 6.0 grams of roast and ground coffee particles of the same size used in Example 3 was placed in the cassette. The cassette was placed in a liquid receptacle, over a bottom opening thereof and hot water was poured through the liquid receptacle and cassette therein the water by-pass was not used.

The following result was obtained:

| | U.S. Pat. No. 4,446,158 Cassette |
|---|---|
| Weight of coffee in cassette (grams) | 6.0 |
| Roast and ground coffee particle size | same as Example 3 |
| Amount of hot water poured through the coffee (ml.) | 140 |
| Time required for the hot water to flow through the coffee | 2 minutes 33 seconds |

A satisfactory cup of coffee is obtained but longer times are required than that of cassette 2 of Example 3 even though less coffee is present here than in Example 3. As the amount of coffee is reduced, the shorter the time required for hot water to pass through the cassette.

The term coffee particles as used herein refers to roast and ground coffee wherein hot or boiling water flows through these particles to extract coffee and to produce a drinkable cup of coffee. Coffee particles or powder referred herein means coffee bean particles or coffee.

Figure 6:
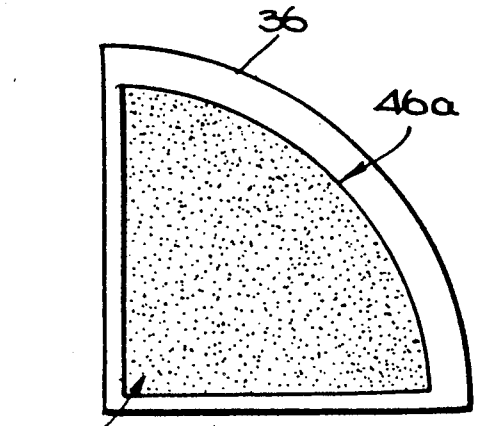
FIG. 6 shows a section of the cassette after it has been removed from a packet in which it was packaged.

FIG. 6 generally illustrates the shape into which the mass of particles in a compartment 46*a* appears to be formed during the above-described procedure for packaging cassette 14. This mass of particles maintains a generally triangular shape, but with the corners of the triangle slightly curved as shown at 50. Further, it appears that the particles are no longer uniformly distributed over the area of compartment 46*a*, but instead there appears to be a slightly higher concentration of the particles toward the center of the compartment and a slightly lower concentration of the particles toward the periphery of the compartment.

While it is apparent that the invention herein disclosed is well calculated to describe the aspects of this invention previously stated, it will be appreciated that numerous modifications and embodiments may be devised by those skilled in the art, and it is intended that the appended claims cover all such modification and embodiments as fall within the true spirit and scope of the present invention.

What is claimed is:

1. A cassette for flavoring a liquid and for use with a liquid receptacle, said liquid receptacle having an interior for receiving liquid and having a bottom portion defining a bottom opening for passing the liquid outward from said interior, said liquid receptacle further including an internal locking flange adjacent to and around said bottom opening and said flange extending upward from said bottom portion, the cassette comprising:

(a) a ring defining an interior and having a bottom surface and a top surface, the ring including
  (i) an inside annular leg,
  (ii) an outside annular leg radially spaced from and concentric with the inside annular leg, and
  (iii) a shoulder portion connected to and extending between the inside and outside annular legs; the inside and outside annular legs and the shoulder portion define a bottom annular groove to receive said locking flange on said liquid receptacle, said cassette including said annular groove being dimensioned and shaped such that when said cassette is placed in said liquid receptacle with said annular groove positioned down onto said locking flange, the cassette is held securely in place while a liquid flows through it and a liquid seal is formed between said cassette and the bottom of the receptacle extending around said opening to prevent liquids from leaking out from the interface between said cassette and said liquid receptacle;

(b) a plurality of ribs connected to and extending across said ring and separating the interior thereof into a multitude of at least 3 sections;

(c) particles disposed in said sections for flavoring a liquid; and (d) a bottom filter and a top filter secured to the ring and extending across the bottom and the top, respectively, of the interior of said ring to hold the flavoring particles therein.

2. A cassette according to claim 1 wherein said internal locking flange has a given width and the inside and outside annular legs of said cassette are radially spaced apart the given width.

3. A cassette according to claim 2 wherein said internal locking flange has a given height and the height of each of said inside and outside legs is said given height.

4. A cassette according to claim 1 wherein:

the bottom filter is secured to the inside leg of said ring; and the bottom filter terminates radially inwardly of said annular groove to avoid interfering with placing the cassette on said locking flange.

5. A cassette according to claim 1 wherein said particles are roast and ground coffee.

6. A cassette according to claim 5 wherein said particles are roast and ground coffee particles having the predominant sizes between about 200 and about 500 microns.

7. A combination of a cassette for flavoring a liquid and a liquid receptacle, said liquid receptacle having an interior for receiving liquid and a bottom portion defining a bottom opening for passing the liquid outward from said interior, said liquid receptacle further including an internal locking flange adjacent to and around said bottom opening and said flange extending upward from said bottom portion; said cassette comprising:

(a) a ring defining an interior and having a bottom surface and top surface, the ring including
  (i) an inside annular leg,
  (ii) an outside annular leg radially spaced from and concentric with the inside annular leg, and
  (iii) a shoulder portion connected to and extending between the inside and outside annular legs; the inside and outside annular legs and the shoulder portion define a bottom annular groove to receive said locking flange of said liquid receptacle; said cassette being mounted in said liquid receptacle with said annular groove positioned down onto said locking flange, said groove and said flange being dimensioned and shaped such that the cassette is held securedly in place while liquid flows through it and a liquid seal is formed between said cassette and the bottom of the receptacle extending around said opening to prevent liquids from leaking out from the interface between said cassette and said liquid receptacle;

(b) a plurality of ribs connected to and extending across said ring and separating the interior thereof into a multitude of at least 3 sections;

(c) particles disposed in said sections for flavoring a liquid; and (d) a bottom filter and a top filter secured to the ring and extending across the bottom and the top respectively of the interior of said ring to hold the flavoring particles therein.

8. The apparatus of claim 7 wherein the beverage particles are roast and ground coffee.

9. The apparatus of claim 8 wherein said particles are roast and ground coffee particles having the predominant sizes between about 200 to about 500 microns.

* * * * *